US005174248A

United States Patent [19]

Couëtoux

[11] Patent Number: 5,174,248

[45] Date of Patent: Dec. 29, 1992

[54] CONTROL BOX FOR A MOTOR VEHICLE ENGINE COOLING SYSTEM

[75] Inventor: Hervé Couëtoux, Neuilly, France

[73] Assignee: Valeo Thermique Moteur, Le Mesnil-Saint-Denis, France

[21] Appl. No.: 741,624

[22] Filed: Aug. 7, 1991

[30] Foreign Application Priority Data

Aug. 8, 1990 [FR] France ..... 90 10148

[51] Int. Cl.[5] ..... F01P 7/02

[52] U.S. Cl. ..... 123/41.12

[58] Field of Search ..... 123/41.12, 41.48, 41.49

[56] References Cited

U.S. PATENT DOCUMENTS

| | | | |
|---|---|---|---|
| 2,544,208 | 3/1951 | Woods | 201/48 |
| 4,955,431 | 9/1990 | Saur et al. | 123/41.12 |
| 5,002,019 | 3/1991 | Klaucke et al. | 123/41.12 |

FOREIGN PATENT DOCUMENTS

| | | | |
|---|---|---|---|
| 42333 | 12/1981 | European Pat. Off. . | |
| 1809554 | 6/1970 | Fed. Rep. of Germany . | |
| 2116087 | 7/1972 | France . | |
| 2568828 | 9/1987 | France . | |
| 53-139033 | 12/1978 | Japan | 123/41.12 |
| 751870 | 7/1956 | United Kingdom . | |
| 981907 | 1/1965 | United Kingdom . | |

*Primary Examiner*—Noah P. Kamen

*Attorney, Agent, or Firm*—Longacre & White

[57] ABSTRACT

A control box is mounted on an external wall of a heat exchanger, such as a motor vehicle engine cooling radiator, adapted for the air cooling of a coolant fluid. The control box contains a temperature sensor for detecting the temperature of the coolant fluid. The control box projects from the outside of the heat exchanger, with the temperature sensor projecting from the main body of the control box into the interior of the heat exchanger. The control box is arranged to switch a motorized fan unit for giving a forced circulation to the cooling air which cools the coolant fluid itself, and is electrically connected directly to an electrical supply source and to the power input terminals of the fan motor.

3 Claims, 2 Drawing Sheets

CONTROL BOX FOR A MOTOR VEHICLE ENGINE COOLING SYSTEM

FIELD OF THE INVENTION

This invention relates to apparatus for the cooling of a heat engine, especially (through not exclusively) for a motor vehicle, in which the cooling system includes a heat exchanger for the air cooling of a coolant fluid which flows in thermal contact with the engine itself, a motorized fan unit for imparting forced circulation of the cooling air through the heat exchanger, and a temperature sensor which is in thermal contact with the coolant fluid. The temperature sensor if thus arranged inside the heat exchanger, and it controls the operation of the motorised fan unit in response to the temperature of the coolant fluid.

In motor vehicle and similar applications, the heat exchanger generally consists of a conventional radiator, the coolant fluid is typically an aqueous solution of an anti-freeze liquid.

BACKGROUND OF THE INVENTION

In apparatus of the kind described above, the motorized fan unit serves to intensify the removal of heat from the coolant fluid, thus preventing it reaching too high a temperature. To that end, the fan is started by means of switching devices when the temperature sensor detects that the temperature of the coolant fluid has passed a predetermined threshold value. The simplest arrangements of this kind include a single fan which is driven by a single motor, the motor being supplied with power under a single, unvarying voltage.

The system thus has two possible states, namely "fan stopped" and "fan running", according to whether the temperature detected is less than the switching threshold value, or greater. More complex systems include a motor which is arranged to be supplied directly, or through a ballast resistor, in such a way as to rotate at two different speeds, or a two-speed motor of the kind having four branches. In an alternative arrangement, thereby may be two motors, each of which drives a separate fan, the motors being arranged to be supplied with power selectively in series or in parallel. These various arrangements have three operating modes, as a function of the cooling fluid temperature. Some systems also include an electronic variator for causing the fan motor speed to vary in continuous fashion.

In the known apparatuses, the switching means, which may for example be relays or electronic components, and which determine whether or not the motorised fan unit is operating at any given moment and, if necessary, any variations in its speed, all under the control of the temperature sensor, are spaced away from the temperature sensor and from the motorised fan unit. The same is true of the ballast resistor where provided: the ballast resistor is placed in the stream of air cooling the heat exchanger so that the resistor itself can be kept cool/ This layout complicates the assembly process and also the wiring of the apparatus.

DISCUSSION OF THE INVENTION

An object of the present invention is to overcome the above drawback. To this end, the invention, in a first aspect, provides a cooling apparatus for a heat engine, especially for a motor vehicle, comprising a heat exchanger for the air cooling of a coolant fluid circulating in thermal contact with the engine, a motorised fan unit adapted to impart forced circulation to the air in contact with the heat exchanger, and a temperature sensor which is in thermal contact with the coolant fluid within the heat motorised fan unit in response to the temperature of the coolant fluid; such an apparatus being characterised in that the temperature sensor is disposed in projecting relationship with, and on, a closed control box which is mounted on an external wall of the heat exchanger, the said control box containing the switching means for the motorised fan unit and being directly connected electrically (via suitable electrical conductors) to an electrical supply source and to the power input terminals of the motor of the motorised fan unit.

In an apparatus in one preferred form in accordance with the invention, the said external wall is part of a fluid-containing vessel defining at least one fluid chamber within it, the temperature sensor being mounted within this chamber.

The apparatus may include a ballast resistor, which may be electrically connected in series with the motor of the motorised fan unit through the switching means, in order to give a reduced fan motor speed. This ballast resistor may, in accordance with a preferred feature of the invention, be arranged in the control box, again in thermal contact with the coolant fluid in the heat exchanger. It is preferably wound in such a way that it surrounds the temperature sensor, being spaced radially from the latter, with the temperature sensor also projecting from the control box into the interior of the heat exchanger.

Preferably, the external wall of the heat exchanger includes an aperture which is sealingly closed, against escape of the coolant fluid, by the control box itself. Such a control box has a heat conductive wall on its side facing towards the interior of the heat exchanger, this heat conductive wall having a projecting tubular portion for carrying the temperature sensor, and also a projecting annular portion surround the projecting tubular portion and containing the ballast resistor. The projecting tubular and annular portions are separated from each other by a free annular space such that in use, it is filled with the coolant fluid.

The aperture in the external wall of the heat exchanger, and the projecting tubular and annular portions of the control box wall, are preferably arranged coaxially with each other.

According to the invention in a second aspect, a control box is provided for a cooling apparatus according to the invention in its first aspect as defined above, and contains the switching means; the control box also has electrical terminals to a source of electrical connection of the terminals to a source of electrical supply and to the power input terminals of an electric motor, and the temperature sensor is arranged in a projecting relationship with the main body of the control box, and is adapted to provide electrical control signals to the switching means.

According to the invention in a third aspect, a heat exchanger having a control box according to the said second aspect of the invention, together with a vessel for containing the coolant fluid, has an external wall on which the control box is mounted, in such a way that the temperature sensor projects into the interior of the heat exchanger (and typically into the interior of the said vessels), so as to be in thermal contact with the coolant fluid in the heat exchanger.

Further features and advantages of the invention will appear more clearly from the detailed description of a preferred embodiment of the invention which follows, given by way of example only and with reference to the Figures of the accompanying drawings.

DESCRIPTION OF A PREFERRED EMBODIMENT OF THE INVENTION

Figure 1:
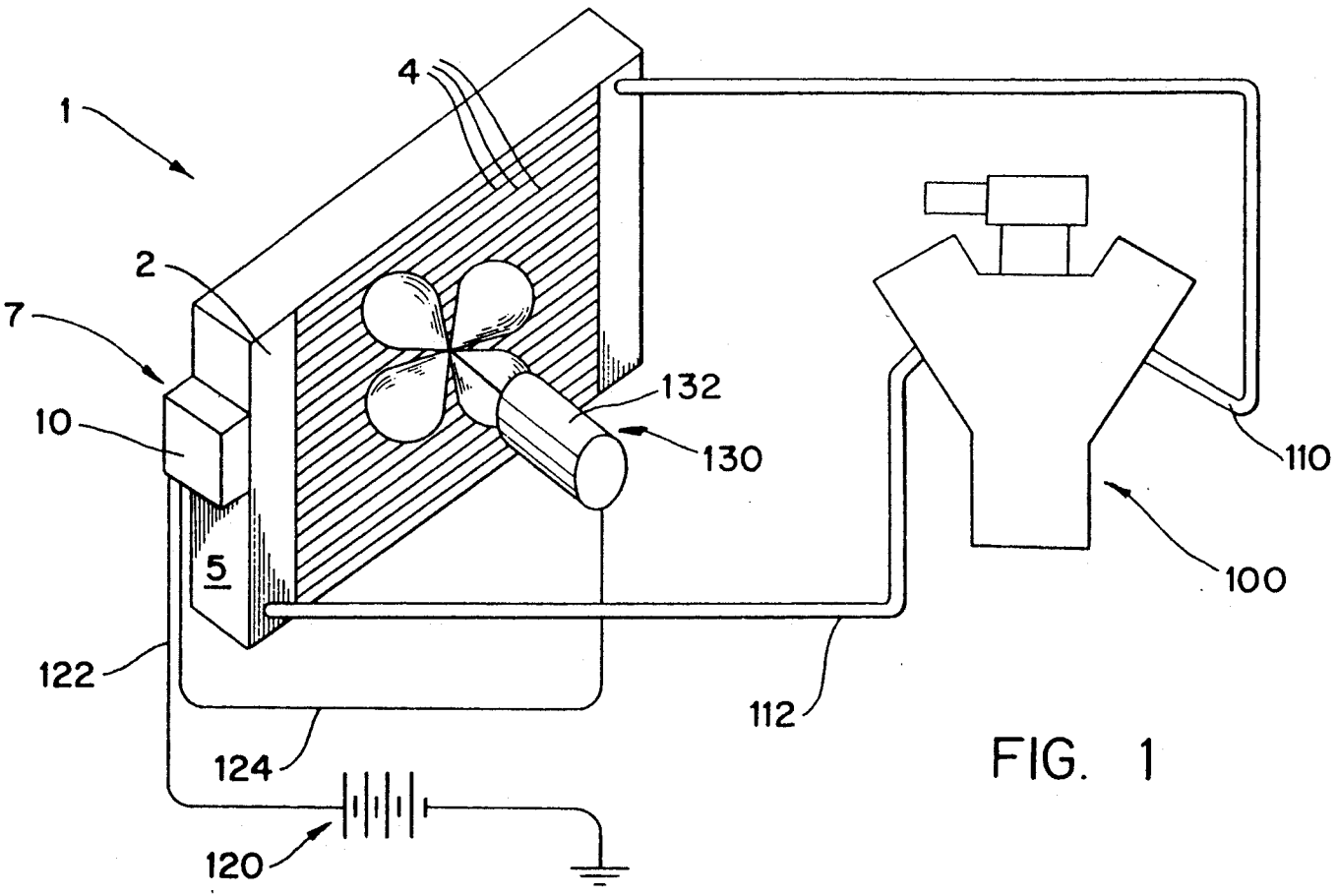
FIG. 1 shows a motor vehicle engine cooling system accordance with the invention.

With reference to FIG. 1, an engine 100 is connected to a heat exchanger 1 by means of coolant supply pipes 110, 112. An electrical energy supply source 120, such as a battery and/or alternator of the vehicle is connected by electrical line 122 to a control box 7 of the instant invention. Another electrical line 124 connects the control box 7 to a motorised fan unit 130 having a motor 132 adapted to force circulation of air in contact with the heat exchanger 1.

Figure 2:
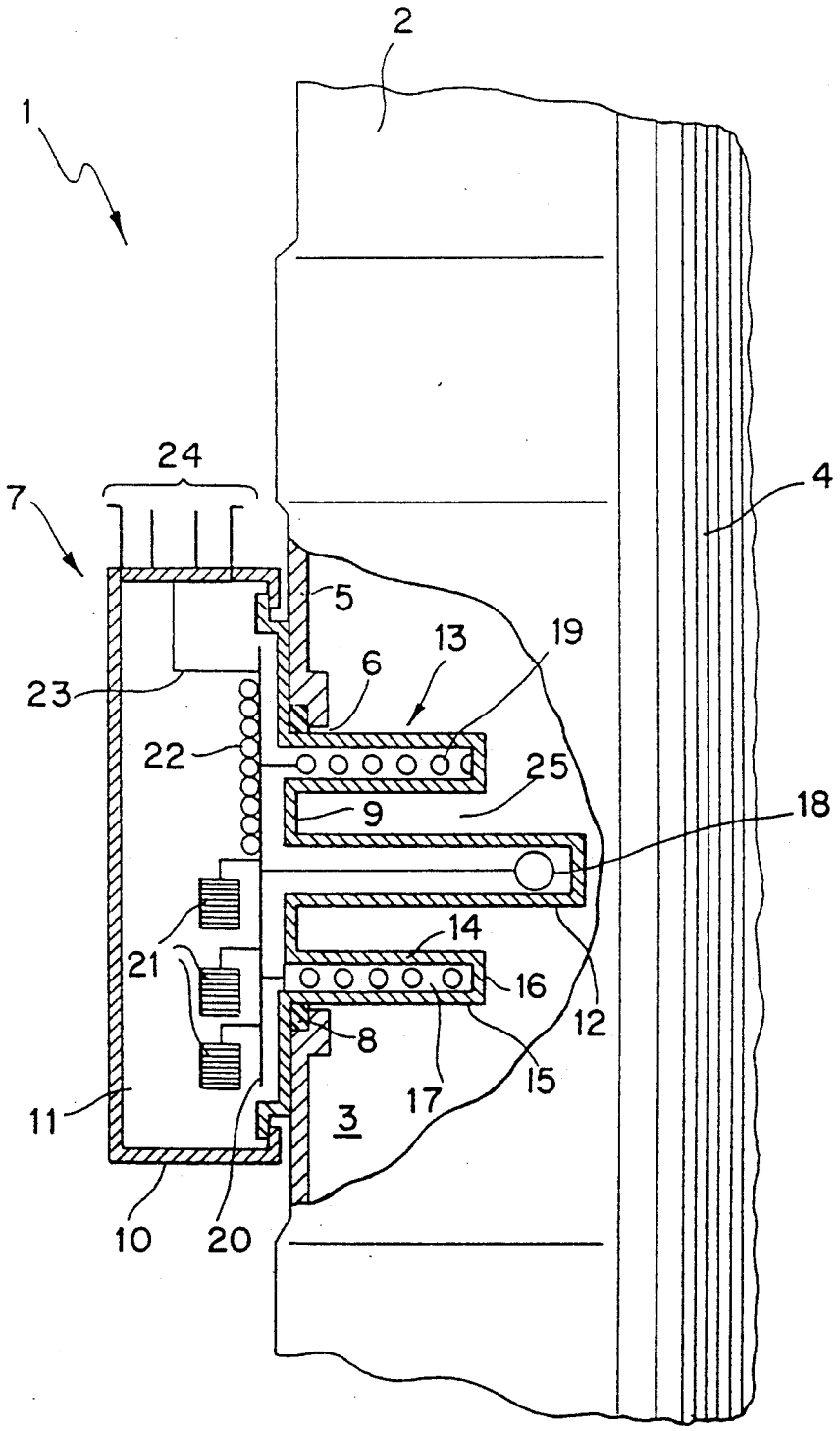
FIG. 2 shows part of a heat exchanger in accordance with the invention, in elevation and partly in cross section.

With reference to FIG. 2, the heat exchanger 1, part of which is shown, includes a fluid-containing vessel 2 which defines at least one chamber 3, and a bundle of tubes 4 which are provided with fins (not shown). The chamber or chambers 3 are filled with a cooling fluid, for example an aqueous solution of an anti-freeze product, and at least part of the tube bundle 4 is in communication with the chamber 3, has a circular aperture 6, which is obturated by a control box 7. An annular seal 8 is interposed between the control box 7 and the aperture 6.

The control box 7 comprises a sole plate 9 and a cover 10. The sole plate 9 is made of a metal having a high thermal conductivity, for example aluminium, while the cover 10 is of a plastic material. The sole plate 9 overlies the outer wall 5 of the vessel 2, and obturates the aperture 6. The cover 10 is fitted over the sole plate 9 so as to be on the outside of the fluid vessel 2, and with the sole plate 9 it defines a closed internal space 11 of the control box 7. The sole plate 9 has a tubular portion 12 which projects into the chamber 3 and which is closed at its free end. The sole plate 9 also has an annular portion 13 which surrounds the tubular portion 12. This annular portion has a cylindrical inner wall portion 14 and a cylindrical outer wall portion 15, joined to the inner wall portion 14 through a terminal wall portion 16, so as to define within the annular portion 13 an annular space 17, which is a separated from the chamber 3 and which communicates with the internal space 11 of the control box. The tubular portion 12 and the annular portion 13 are coaxial with the circular aperture 6.

The tubular portion 12 contain a temperature sensor 18, for example a thermistor, while the annular portion 13 contains a ballast resistor 19. The thermistor 18 and ballast resistor 19 are in thermal contact through the wall of the sole plate 9 with the coolant fluid contained in the chamber 3, which washes against the said wall. The internal space 11 of the control box 9 contains a printed circuit 20 which is connected to the thermal sensor 18 and to the ballast resistor 19. The printed circuit 20 carries switching elements, for example relays 21 and electronic components 22. The printed circuit 20 is also connected, through conductors 23 situated in the internal space 11, with electric terminals 24 mounted on the cover 10 and projecting away from the control box. The terminals 24 are arranged to be connected directly, through suitable electrical conductors 122, 124, firstly to a supply source 120 such as the battery and/or the alternator of the vehicle, and secondly to the power supply terminals of the motor 132 of a motorised fan unit 130. These electrical connections are such that this motor 132, according to the state of the switching elements in the control box 7 as determined by the temperature sensor 18, is supplied either under substantially the full voltage of the supply source 120, or under a reduced voltage, being connected in series with the ballast resistor 19; or it may be in open circuit.

The annular portion 13 of the sole plate 9 is spaced radially away from the tubular axial portion 12 of the latter, so as to leave and axial space 25 between them, this axial space 25 being filled with the cooling fluid. This avoids any significant influence being exerted by the heat emitted by the ballast resistor 19 on the temperature detected by the sensor 18, while enabling this heat to be evacuated efficiently by the fluid flowing in the annular space 25.

Means (not shown) may be provided to enable the control box 7 to be fitted rapidly to the fluid vessel 2, for example by means of a bayonet fitting.

Additional electrical terminals may be provided on the control box when data other than the cooling fluid temperature are required to be taken into consideration in the control of the motorised fan unit. Such further data may for example come from an on-board computer.

The annular portion of the sole plate of the control box may of course be omitted with the apparatus does not include a ballast resistor.

What is claimed is:

1. Cooling apparatus for a motor vehicle engine, comprising: a heat exchanger for air cooling of a coolant fluid flowing in thermal contact with the vehicle engine; a motorised fan unit for producing a forced circulation of air in contact with the heat exchanger, the motorised fan unit including a motor having power input terminals; an electric supply source; and a closed control box, the heat exchanger having an outer wall and the control box being mounted on said outer wall, and the apparatus further comprising: a temperature sensor for controlling the operation of the motorised fan unit according to the temperature of said cooling fluid; and means mounting the temperature sensor inside the heat exchanger so as to be in thermal contact with said cooling fluid flowing therein, the control box including said means mounting the temperature sensor, in projecting relationship from the control box, said switching means within the control box, and the apparatus further comprising electrical conductor means connecting the switching means directly with said electric supply source and motor input terminals, whereby the switching means can control the motorised fan unit in response to data from the temperature sensor; the apparatus further comprising a ballast resistor, the control box further including means mounting the ballast resistor in the control box in thermal contact with the interior of the heat exchanger so that the ballast resistor is in thermal contact with said coolant fluid in the heat exchanger, the ballast resistor being electrically connected through said switching means so that it can be electrically in series with the motor of the motorized fan unit whereby said motor can run at a reduced speed; wherein the ballast resistor is in the form of a winding, the means mounting it in the control box being such that the ballast resistor extends around the temperature sensor while being spaced from it, with the ballast resistor disposed within the heat exchanger.

2. Apparatus according to claim 1, wherein said external wall of the heat exchanger is formed with an aperture, with the control box obturating said aperture and the apparatus further comprising sealing means in said aperture to seal it against escape of coolant fluid from within the heat exchanger, and wherein the control box includes a thermally conductive wall facing towards the interior of the heat exchanger, said thermally conductive wall having a tubular projecting portion and an annular projecting portion surrounding the tubular projecting portion, the temperature sensor being mounted in the tubular portion and the ballast resistor being mounted in the annular portion, the tubular and annular portions defining between them a free annular space which is open within the heat exchanger so as to be filled with coolant fluid.

3. Apparatus according to claim 2, wherein said aperture in the outer wall of the heat exchanger, said projecting tubular portion, and said projecting annular portion, are all coaxial with each other.

* * * * *